United States Patent [19]

Mercurio

[11] 4,197,932

[45] Apr. 15, 1980

[54] COIN CHUTE HAVING SINGLE MULTIPLE COIN STAGGERED APERTURE

[76] Inventor: Leonard Mercurio, 17 Quintree La., Dix Hills, N.Y. 11746

[21] Appl. No.: 959,339

[22] Filed: Nov. 9, 1978

[51] Int. Cl.[2] ..... G07F 5/04

[52] U.S. Cl. ..... 194/92; 194/DIG. 2

[58] Field of Search ..... 194/1 G, 92, 93, 102, 194/DIG. 2

[56] References Cited

U.S. PATENT DOCUMENTS

| | | | |
|---|---|---|---|
| 3,361,241 | 1/1968 | Hall | 194/1 G X |
| 3,732,962 | 5/1973 | Hall | 194/92 |
| 3,887,054 | 6/1975 | Allen | 194/92 |

*Primary Examiner*—F. J. Bartuska

*Attorney, Agent, or Firm*—Charles E. Temko

[57] ABSTRACT

A coin chute of a type for use with vending machines, laundry washing and drying apparatus and the like, having provision for accepting a plurality of coins in overlapped, staggered relation, whereby the coin chute may be of relatively standard width so as to be installable in existing devices, and may accept coins of larger denomination. Improved detection structure is provided for sizing coins to very close tolerances, thereby permitting highly accurate foreign coin and slug rejection.

2 Claims, 10 Drawing Figures

COIN CHUTE HAVING SINGLE MULTIPLE COIN STAGGERED APERTURE

BACKGROUND OF THE INVENTION

Coin chutes of the above described type have been in wide use for many years, in both the vending machine and laundry fields. With continued inflation, the necessity has arisen to provide for acceptance of a greater amount of coins for each cycle of operation. Since it is desirable to place all coins in the coin slide in transversely aligned relation, and existing devices using coin chutes have space of given width allocated to this structure, such devices have not been convertible to accept more or larger coins per cycle. In the case of laundry dryers, for example, it has been necessary to shorten the drying cycle, necessitating the insertion of coins a second time before clothes are dried to a desired degree.

SUMMARY OF THE INVENTION

Briefly stated, the invention contemplates the provision of a coin chute, the slide member of which is of a width corresponding to that of a conventional slide, and in which recesses are provided for overlapped disposition of coins of large denomination. Sensing means is provided portions of which project into the above recess for determining undersized, substituted or counterfeit coins.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
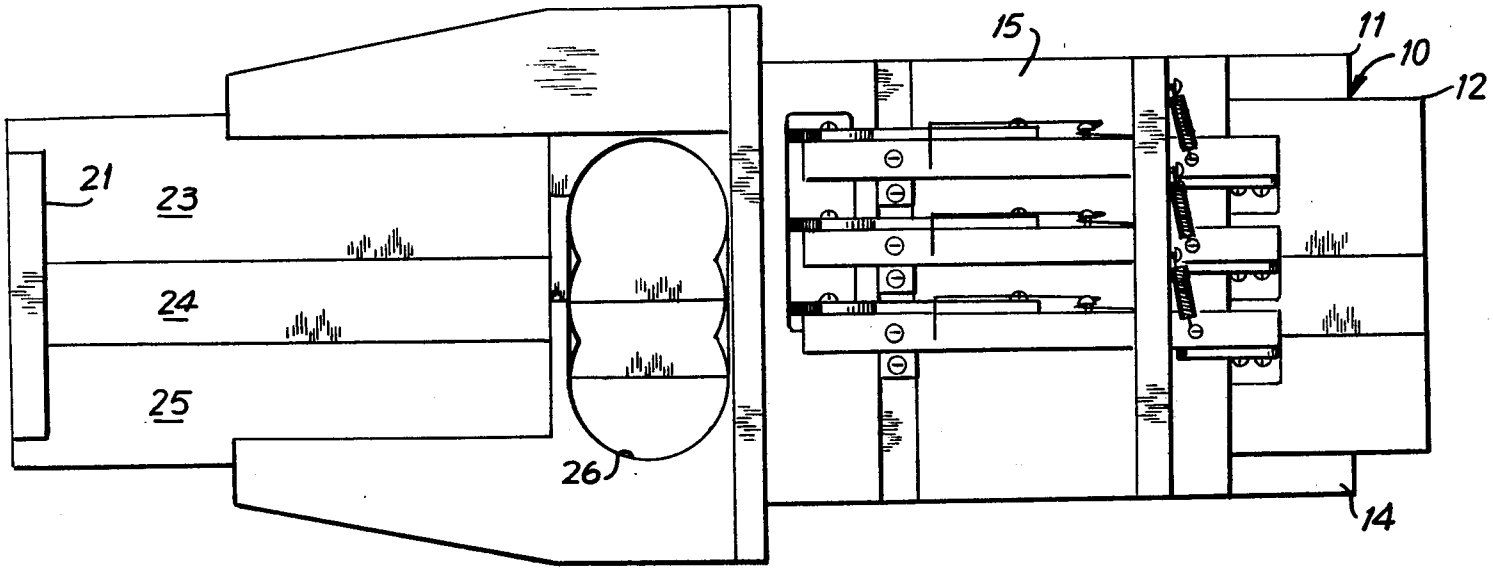
FIG. 1 is a top plan view of an embodiment of the invention, showing the coin slide element thereof in open condition.

In accordance with the principal embodiment of the invention, the device, generally indicated by reference character 10, comprises broadly; a relatively fixed element 11, and a movable coin slide element 12.

Figures 3, 4, 5, 6, 7, 8, 9, 10:
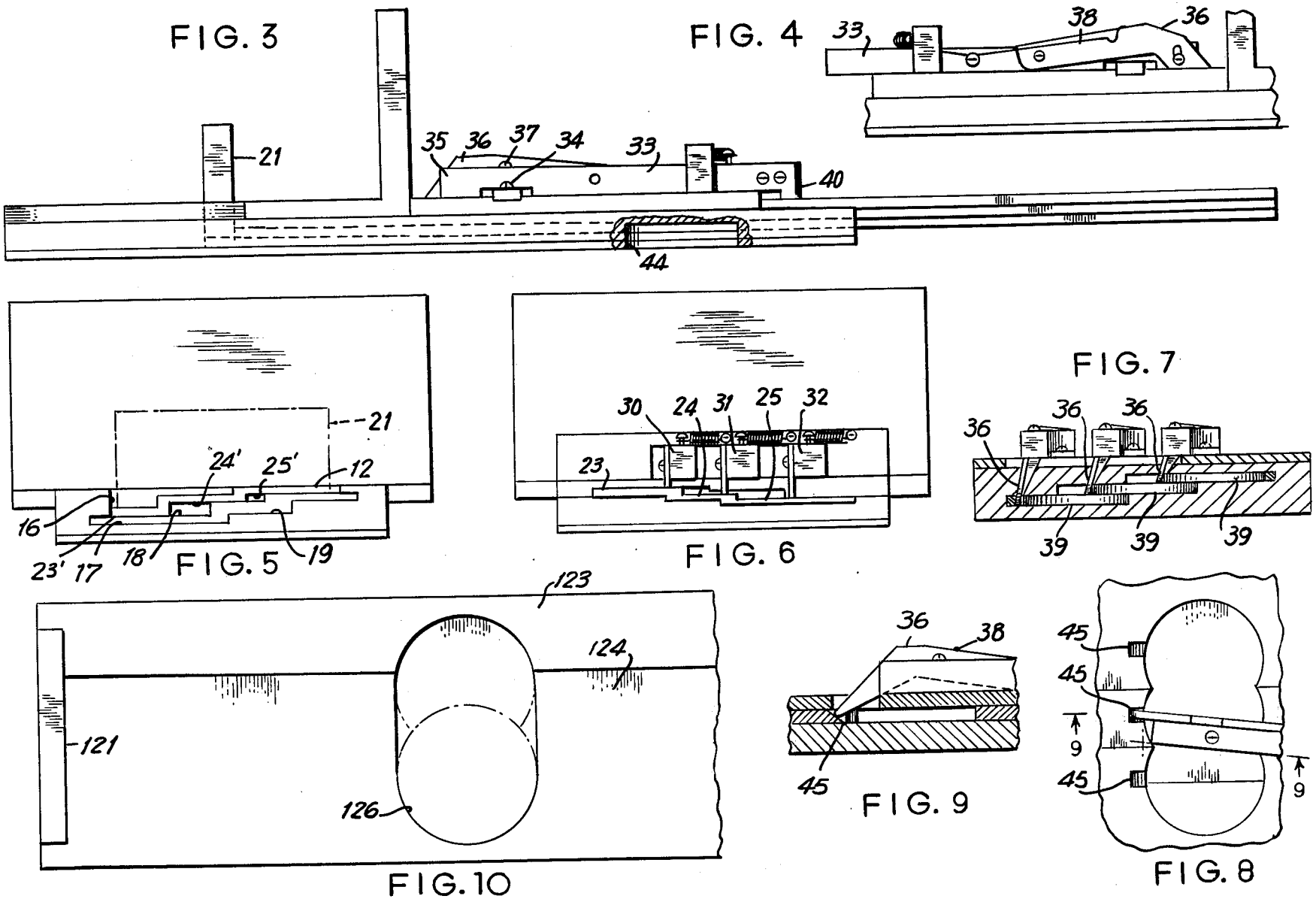
FIG. 3 is a side elevational view thereof, partly broken away to show details.
FIG. 4 is a fragmentary side elevational view corresponding to the central portion of the side opposite that seen in FIG. 3.
FIG. 5 is an outer end elevational view of the embodiment.
FIG. 6 is an inner end elevational view thereof.
FIG. 7 is a transverse sectional view as seen from the plane 7—7 in FIG. 2.
FIG. 8 is a top plan view thereof, with certain structure removed showing a partially inserted position of the coin slide.
FIG. 9 is an offset sectional view as seen from the plane 9—9 in FIG. 8.
FIG. 10 is a fragmentary top plan view of an alternate form of a coin slide.

The fixed element 11 includes a lower planar member 14, and an upper planar member 15 forming an interstice 16 therein in which the slide element 12 moves. Referring to FIG. 5, the interstice includes a plurality of staggered channels 17, 18 and 19, corresponding to the number of coins which can be accepted during any one cycle of operation.

The slide element 12 is adapted to be manually moved within the interstice 16 and is provided with a corresponding cross-sectional configuration. It includes a manually engageable member 21, a main body member 22, having staggered surfaces 23, 24 and 25 on the upper portion thereof, and corresponding staggered surfaces 23',24' and 25' on the lower portion thereof. A transverse recess 26 extends over the staggered surfaces 23–25, and permits staggered coins 39 to rest upon the correspondingly staggered upper surface of the lower planar member 14, in a manner well known in the art.

The coin sensing means includes a plurality of sensing elements 30, 31 and 32 (where three coins are involved during a single operational cycle), each including a first class lever 33 mounted for rotation about a vertical axis 34. A forward end 35 mounts a feeler member 36 supported by a horizontal axis screw 37 and urged downwardly by a spring 38. As best seen in FIG. 7, coins 39, when properly sized, deflect the feeler member 36 in a horizontal plane causing the levers 33 to pivot wherein a projection 40 on an opposite end 41 of each lever clears a notch 42 in slotted openings 43 in the slide element 12, permitting movement of the slide element to the position shown in FIG. 3 wherein the coins drop through an opening 44 in the lower planar member 14. If the coins 39 are only slightly undersized, the deflection of the levers 33 is not sufficient to permit this action to take place.

Figure 2:
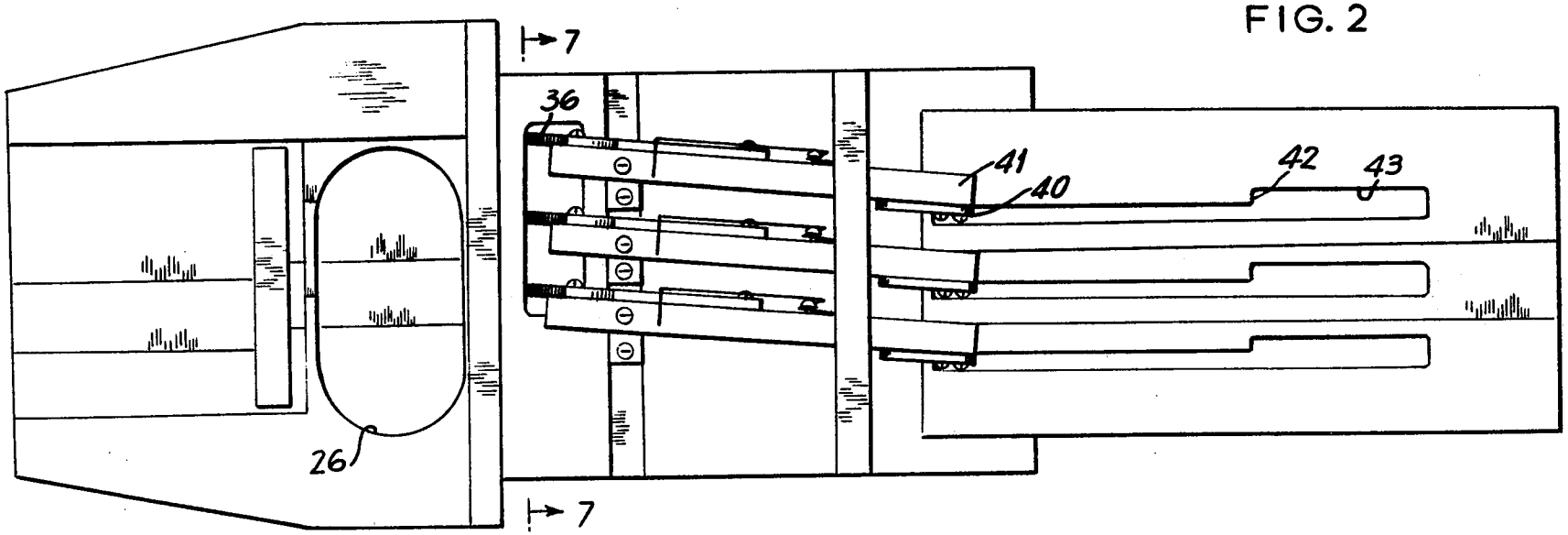
FIG. 2 is a similar top plan view thereof showing the coin slide in fully closed condition.

Once the properly sized coins have been cleared, a cam surface 45 for each lever 33 deflects the feeler members 36 upwardly (FIG. 9), permitting the slide element 12 to move fully to the right, as seen in FIG. 2, to operate electrical switch means on the device (not shown) in which the coin chute is installed.

Turning now to the alternate form shown in FIG. 10 in the drawing, parts corresponding to those of the principal form have been designated by similar reference characters with the additional prefix "1."

The alternate form differs from the principal form in the provision of only two staggered upper surfaces, 123 and 124, as distinguished from three corresponding surfaces in the principal form. The alternate form is for use with coins of relatively large denomination, as for example two half dollars, as contrasted with three coins, such as a quarter, a nickel and a dime.

I wish it to be understood that I do not consider the invention limited to the precise details of structure shown and set forth in this specification, for obvious modifications will occur to those skilled in the art to which the invention pertains.

I claim:

1. An improved coin chute construction for use with coin operated devices for initiating the operation thereof, comprising: a first relatively fixed element and a movable coin chute element mounted for reciprocating movement thereon; said fixed element including means defining at least three parallel channels disposed in mutually staggered relation, said slide element including an elongated main body member defining upper and lower surfaces corresponding to the staggered channels defined by said fixed element, and having a transverse recess therein, wherein a plurality of coins corresponding to the number of parallel channels may be positioned in mutually staggered overlapping relation to rest upon a corresponding upwardly facing surface of said fixed element; and a corresponding plurality of sensing elements, one for each of said staggered channels disposed in mutually parallel relation to detect the passage of a coin in a respective channel, and inhibit sliding motion of said slide element in the absence of a proper coin in each channel.

2. A coin chute construction in accordance with claim 1, further characterized in each of said sensing elements including a first class lever mounted for rotation about a vertical axis, a feeler member mounted upon a forward end of each of said levers, resilient means urging said feeler members into said transverse recess, said feeler members being deflected upon detecting the presence of a properly sized coin to pivot said levers whereby oppositely disposed ends thereof clear corresponding obstructions on said fixed member to enable full traverse of said slide element upon said fixed element.

* * * * *